United States Patent [19]

Child

[11] 4,099,932

[45] Jul. 11, 1978

[54] CONVERSION OF SOLID FUELS TO FLUID FUELS

[75] Inventor: Edward T. Child, Tarrytown, N.Y.

[73] Assignee: Texaco Development Corporation, New York, N.Y.

[21] Appl. No.: 782,154

[22] Filed: Mar. 28, 1977

[51] Int. Cl.[2] ..... C10J 3/00; C10J 3/16

[52] U.S. Cl. ..... 48/197 R; 48/210; 208/8; 252/373

[58] Field of Search ..... 48/197 R, 206, 215, 48/210; 252/373; 208/8

[56] References Cited

U.S. PATENT DOCUMENTS

| | | | |
|---|---|---|---|
| 3,341,447 | 9/1967 | Bull et al. | 208/8 |
| 3,816,332 | 6/1974 | Marion | 48/215 |
| 3,884,796 | 5/1975 | Hinderliter | 208/8 |
| 3,917,569 | 11/1975 | Richter et al. | 48/215 |
| 3,964,882 | 6/1976 | Standinger | 48/215 |
| 4,007,129 | 2/1977 | Naber et al. | 252/373 |
| 4,008,054 | 2/1977 | Clancey et al. | 208/8 |

*Primary Examiner*—S. Leon Bashore
*Assistant Examiner*—Peter F. Kratz
*Attorney, Agent, or Firm*—Thomas H. Whaley; Carl G. Ries; Robert Knox, Jr.

[57] ABSTRACT

Solid fossil fuels are converted into liquid and/or gaseous fuels by solving refining the solid fuel, subjecting the heaviest portion of the solvent refined fuel to partial oxidation to produce synthesis gas containing entrained soot, transferring the soot to the solvent-refined coal and returning the soot with the charge to the gasification zone.

10 Claims, 1 Drawing Figure

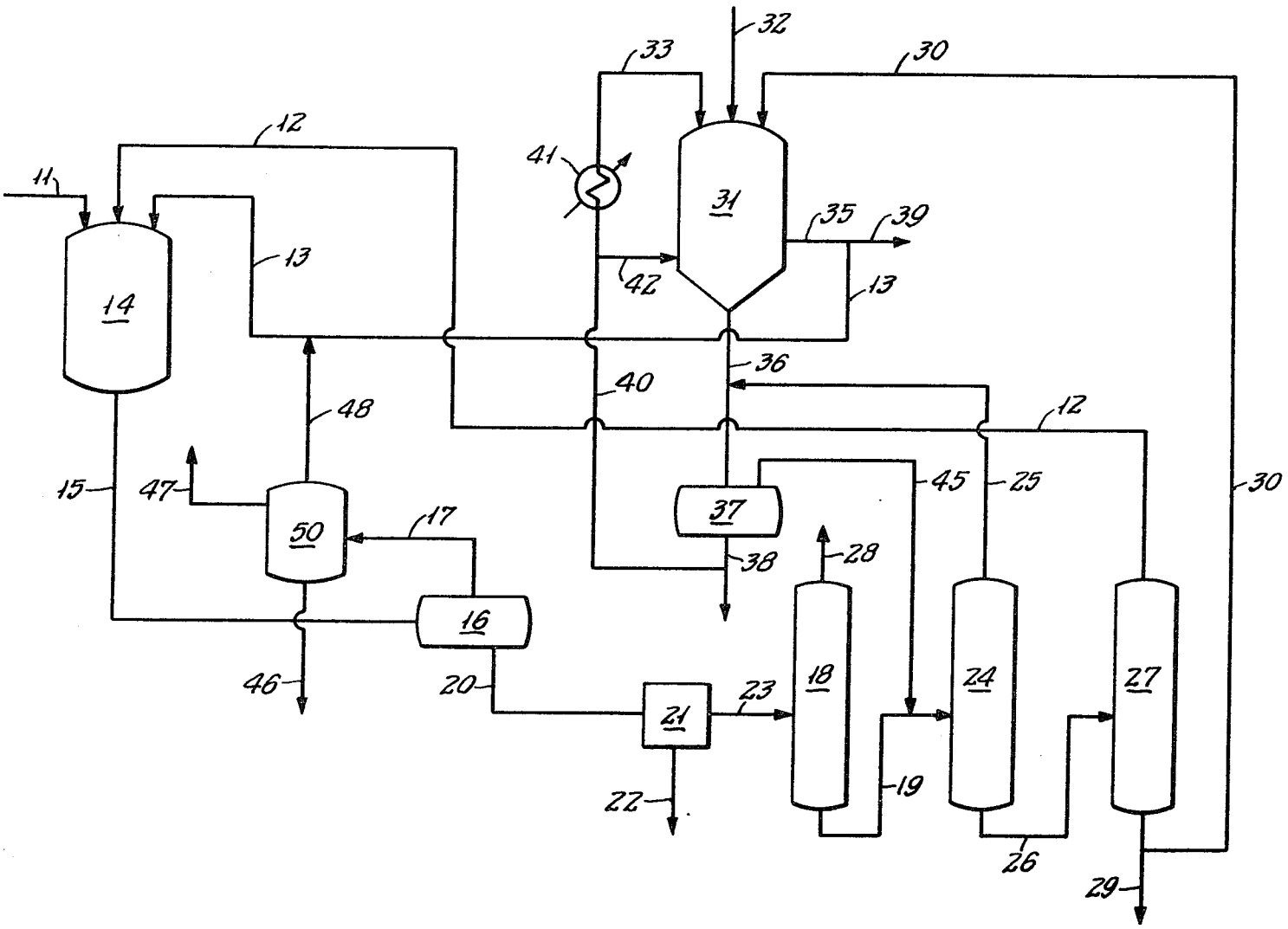
11
12
13
14
15
16
17
18
19
20
21
22
23
24
25
26
27
28
29
30
31
32
33
35
36
37
38
39
40
41
42
45
46
47
48
50

CONVERSION OF SOLID FUELS TO FLUID FUELS

This invention is concerned with the conversion of solids to gases. More particularly, it is concerned with the conversion of solid fuels into gases suitable for the synthesis of organic compounds, suitable for the production of hydrogen or suitable for use per se as a fuel.

Fossil fuels are found in the earth in each of the three forms; solid, liquid and gas. Of the three, solid fuel is less advantageous than the other two. Frequently, it has a relatively high sulfur content making it unsuitable for use as a fuel because of its $SO_2$ emission on combustion. It is also much more convenient to transport liquid and gaseous fuels than it is to transport solid fuel. Fluid fuels such as gases and liquids are ordinarily transported by pipeline whereas solid fuels are conventionally transported by rail. In addition, liquid and gaseous fuels such as petroleum oils and natural gas are more suitable for use as starting materials in the synthesis of organic compounds.

It is therefore an object of this invention to convert solid fossil fuels into fluid fuels. It is also an object of this invention to convert a solid fuel into a gaseous fuel of reduced sulfur content. Still another object is to convert a solid fossil fuel into a form useful for the synthesis of organic compounds. These and other objects will be obvious to those skilled in the art from the following disclosure.

According to my invention there is provided a process for the production of a gas comprising carbon monoxide and hydrogen which comprises mixing finely divided solid fuel with a solvent therefor, heating the resulting mixture to a temperature between about 700° and 900° F. in a solvation zone to solubilize said solid fuel, removing the heated mixture of solvent and solubilized fuel from the solvation zone and adding particulate carbon or soot to form a suspension thereof in solubilized fuel, subjecting the suspension of particulate carbon or soot in solubilized fuel to partial oxidation to produce said gas comprising carbon monoxide and hydrogen and also containing therein suspended particles of carbon and transferring the carbon particles to suspension in solubilized fuel to form additional suspension for use as feed to the partial oxidation zone.

The solid fossil fuels which may be used as feedstock for the process of my invention include such solid fuels as anthracite, bituminous coal, sub-bituminous coal, lignite, petroleum coke and the like. The solid fuel should be in particulate form and may be ground to a particle size no greater than about ¼ inch with preferably at least 50% passing through a 200 mesh U.S. Standard sieve and still more preferably at least 75% passing through a 200 mesh U.S. Standard sieve. It is desirable for the solid fuel to have a moisture content no greater than about 5% and preferably less than 3% by weight. Accordingly, if the fuel contains a higher percentage of water advantageously it may be subjected to drying such as by contact with a hot gas, e.g., flue gas, synthesis gas and the like.

In the following specification for the sake of simplicity, the solid fossil fuel will be referred to as coal but it should be kept in mind that the term "coal" in this respect is used in a generic sense.

The solvent used in the process of my invention should have a boiling range of from about 350° to 900° F. preferably from about 500° to 800° F. and advantageously will contain a considerable amount of hydroaromatic compounds. Once the process has been on stream for some time a suitable boiling range portion of the liquefied coal produced during the solvation step may be recycled thereto. However, at startup the solvent may comprise anthracene oil, creosote oil, a petroleum distillate such as cycle gas oil, tetralin, decalin and/or other hydroaromatic compounds. The solvent should be present in the solvation zone in an amount between about 0.5 and 5 parts by weight per part of coal preferably between about 1 and 4 parts solvent per part of coal by weight. The coal-solvent mixture is heated to a temperature between about 700° and 900° F. in a solvation zone which may comprise a vessel equipped with agitation. In a preferred embodiment of the invention the agitation is provided by passing the mixture of finely divided coal and solvent through an elongated heating zone having a length to diameter ratio of at least 100 and preferably at least 1000 under conditions of turbulent flow. The heating in the solvation step may generally be effected under super-atmospheric pressure preferably within the range of about 100 to 5000 psig and still more preferably between 500 and 2000 psig.

The solvation of the coal may take place in the presence of added hydrogen. Although the addition of hydrogen is not essential to the operation of the process it is a preferred mode of operation. The hydrogen added to the solvation zone need not necessarily be pure but should contain at least about 30% hydrogen. In this respect, the term hydrogen includes impure hydrogen. Ordinarily the hydrogen will not be more than 95% pure. Examples of hydrogen are synthesis gas such as that produced by the present process and which usually contains approximately equal amounts of carbon monoxide and hydrogen, hydrogen produced as a by-product in the catalytic reforming of petroleum naphtha and hydrogen produced by electrolysis. When hydrogen is added to the solvation zone, the pressure may be increased to provide a hydrogen partial pressure up to about 1500 psig. The hydrogen calculated as pure hydrogen may be present in the solvation zone in an amount between about 20 and 100 scf/lb. of coal preferably between 40 and 80 scf/lb. of coal.

The residence time in the solvation zone may be between about 10 minutes and 1 hour preferably between about 15 and 30 minutes. Actually the residence time should be long enough to allow for the solvation of about 95% of the organic material present in the coal. It will therefore be appreciated by those skilled in the art that the fineness of the grind, the temperature, the pressure and the amount of agitation will all have an effect on the residence time.

After the solvation has been effected, the mixture is removed from the solvation zone and gaseous material, either hydrogen or gases formed during the solvation procedure are flashed from the effluent. The remaining liquid material may then be filtered to remove mineral residue and undissolved coal. This filtration may take place directly as the effluent leaves the solvation zone or after the flashing or after distillation for the removal of the light liquids. If it is desired to gasify all of the solvation zone effluent the filtration step may be omitted. However, in this event, it will be necessary to constantly supply fresh solvent to the solvation zone. The filtrate is then distilled to separate a fraction boiling up to about 700°-900° F. for use as solvent to be recycled to the solvation zone with any excess being removed as product of the process. The heavier material boiling above the end point of the solvent is then subjected to gasification in a conventional manner in which the solvent-refined material is subjected to partial oxidation in the presence of added water or steam to form a gas comprising carbon monoxide and hydrogen and containing entrained particles of soot. The soot is then transferred to additional solvent-refined coal and, dispersed therein, is charged as feed to the gasification zone.

In one embodiment of the invention, the transfer of the soot may be effected by contacting the hot synthesis gas with water in a quench chamber or scrubbing tower for cooling of the synthesis gas and simultaneous removal of soot and any particles of ash contained therein. The quench water containing the dispersed soot is then intimately contacted with hydrocarbon liquid to transfer the soot particles from the water to the hydrocarbon liquid. Any hydrocarbon liquid which does not form severe emulsions with water may be used for this purpose but in a preferred embodiment the hydrocarbon liquid has an end boiling point not in excess of about 450° F. such as naphtha. The hydrocarbon liquid may be contacted intimately with the water in an amount sufficient to form a dispersion of the soot particles in the hydrocarbon liquid containing up to about 10 weight percent soot as disclosed in U.S. Pat. No. 2,992,906 to Guptill and then the naphtha-soot dispersion is mixed with solvent refined coal. This mixture is distilled to remove the naphtha leaving a dispersion of soot in solvent refined coal. Alternatively, the hydrocarbon liquid may be mixed with the water in an amount just sufficient to cause the soot particles to rise to the surface of the water as a dry fluffy powder as disclosed in U.S. Pat. No. 3,917,569 to Richter et al, these disclosures being incorporated herein by this reference thereto. The soot is then removed from the surface of the water by the addition of more light hydrocarbon liquid. In this manner, the soot is transferred from the water to the hydrocarbon liquid. The hydrocarbon liquid-soot dispersion preferably containing between about 1 and 5 wt.% soot is then mixed with solvent-refined coal and the mixture heated to remove the hydrocarbon liquid by distillation leaving a dispersion of the soot in the solvent-refined coal. This dispersion is then used as feed to the gas generator. The distilled hydrocarbon liquid or naphtha may then be used for the recovery of additional soot from quench water. This procedure is particularly suitable when the synthesis gas is to be used as feed to a shift conversion unit for the production of hydrogen as the water quench results in synthesis gas saturated with steam.

For a better understanding of the invention, reference is now made to the accompanying drawing which shows diagramatically a flow scheme for the practice of the invention. It will be apparent to those skilled in the art that various pieces of equipment such as the valves, pumps, compressors and the like have been omitted for the sake of simplicity.

Referring now to the drawing, finely divided coal in line 11 and solvent in line 12 with hydrogen-containing gas from line 13 are introduced into solvation unit 14 where the bulk of the organic material in the coal is dissolved in the solvent. The effluent from solvation zone 14 passes through line 15 to high pressure separator 16 where gaseous materials such as hydrogen, $CO_2$, $H_2S$ and hydrocarbon gases formed during the solvation step are removed by means of line 17. The liquid effluent from high pressure separator 16 is transferred through line 20 to filter 21 where mineral residue is removed through line 22. Since the mineral residue contains about 50% carbon, it may be included in the feed to gasifier 31. The filtrate from filter 21 passes through line 23 to column 18 where liquids boiling up to about 450° F. formed during the solvation step are removed through line 28. The 450° F.+ material then passes through line 19 to naphtha stripper 24 where naphtha containing dispersed soot introduced from line 45 is removed and recycled by means of line 25. Bottoms from naphtha stripper 24 comprising soot, solvent and solvent refined coal are then transferred via line 26 to column 27 where solvent boiling up to about 800°-900° F. is recycled to solvation unit 14 through line 12 and bottoms comprising soot dispersed in solvent refined coal are removed through line 29. A portion or all of the bottoms may be sent to gasifier 31 through line 30 where with oxygen from line 32 and steam or water or a mixture thereof from line 33, it is subjected to partial oxidation to form a synthesis gas composed predominantly of carbon monoxide and hydrogen. The synthesis gas so produced then passes to a quench chamber in the lower section of gasifier 31 where it is introduced into water under the surface thereof by means of a distributing device (not shown). The product gas passes upwardly through the quench water and is removed from gasifier 31 through line 35. A portion of the substantially soot-free product gas is returned to solvation unit 14 by means of line 13 and the balance is withdrawn from the system as product of the process through line 39. The quench water containing dispersed soot is removed from gasification zone 31 through line 36 and is mixed with light hydrocarbon material (naphtha) boiling up to about 450° F. from line 25 and the mixture is introduced into decanter 37 where it is separated into two phases, a hydrocarbon-soot phase and a substantially soot-free water phase. The water is removed from decanter 37 by means of line 38, a portion being discharged from the system and the balance being recycled to gasification unit 31 through lines 40 and 33. If desired, the quench water can be converted to steam by means of heater 41. A portion of the quench water may be returned to the quench chamber in gasification unit 31 through line 42. Naphtha containing dispersed soot leaves decanter 37 through line 45 and is mixed with bottoms from column 18 in line 19 to form a mixture of naphtha, solvent, solvent-refined coal and soot which then goes to still 24 for separation of the naphtha.

Hydrogen removed from high pressure separator through line 17 may be purified in hydrogen purification zone 50 where it is contacted with an aqueous ethanolamine solution for removal of $CO_2$ and $H_2S$ which leave purification zone 50 through line 46. If high purity hydrogen for recycle is desired a cryogenic separation may be made with light hydrocarbons leaving through line 47 and hydrogen being recycled through lines 48 and 13. Otherwise the hydrogen and light hydrocarbons may be recycled to solvation zone 14 through lines 48 and 13. However, to prevent the build-up of light hydrocarbons, it is desirable to remove at least a portion of the light hydrocarbons, e.g., methane and ethane from the recycle stream.

The following examples are submitted for illustrative purposes only and it should not be construed that the invention is restricted thereto.

EXAMPLE I

This example is designed for maximum production of solvent refined coal for external use with no excess production of synthesis gas. The charge is a Western Kentucky bituminous coal having the following analysis:

TABLE 1

| | |
|---|---|
| Carbon | 70.7 wt. % |
| Hydrogen | 4.7 wt. % |
| Nitrogen | 1.1 wt. % |
| Sulfur | 3.4 wt. % |
| Oxygen | 10.0 wt. % |
| Ash | 7.1 wt. % |
| Moisture | 3.0 wt. % |

One ton per day of the feed with 2 tons per day of a 450°-900° F. boiling range solvent produced in a previous run are fed to a solvation vessel maintained at 825° F. and a pressure of 1500 psig. Also introduced is 50,000 standard cubic feet per day of a mixture of recycle gas and synthesis gas produced as described below having the following composition:

TABLE 2

| | |
|---|---|
| $H_2$, mol % | 35.5 |
| CO, mol % | 45.4 |
| $CO_2$ mol % | 16.9 |
| $CH_4$ mol % | 0.8 |
| $N_2$ mol % | 0.6 |
| A mol % | 0.6 |
| $H_2S$ mol % | 0.2 |

Residence time in the vessel is 15 minutes with a disappearance of $H_2$ + CO of 7,600 SCF per day. Filtration of the liquid effluent from the solvation vessel yields 284 pounds per day of a filter cake containing 50% ash. The filtrate is then topped to remove light liquids boiling up to 450° F. amounting to 100 pounds per day. To the bottoms from this topping operation is added 258 pounds per day of naphtha containing dispersed soot obtained as described below. The naphtha is combined with the mixture of solvent and solvent refined coal and the combination is distilled to remove the naphtha and then further distilled to remove 2 tons per day of solvent which is recycled to the solvation zone. Bottoms from this distillation amounts to 1000 pounds per day of solvent refined coal, 212 pounds being sent to the gasifier and 788 pounds per day being recovered. The solvent refined coal has the following analysis:

TABLE 3

| | |
|---|---|
| Carbon | 88.5 wt. % |
| Hydrogen | 5.1 wt. % |
| Nitrogen | 1.8 wt. % |
| Sulfur | 0.8 wt. % |
| Oxygen | 3.7 wt. % |
| Ash | 0.1 wt. % |

The feed to the gasifier includes 212 pounds per day of solvent refined coal, 244 pounds per day of oxygen of 98% purity and 212 pounds of water per day which yields 7,600 SCF of synthesis gas per day having the composition disclosed in Table 2. The gasifier is operated at a pressure of 1600 psig. 2% of the carbon in the feed is unconverted and appears in the synthesis gas as soot particles. The soot is removed from the gas by water quenching and the soot-free gas is sent to the solvation vessel. 400 pounds of quench water containing soot is mixed with 258 pounds per day of naphtha to which the soot is transferred and the soot is then dispersed in the solvent refined coal as described above. The 788 lbs. per day of solvent refined coal product is suitable for use as a clean boiler fuel or may be subjected to further treatment for the production of chemicals or chemical intermediates or lower boiling fuels.

EXAMPLE II

This example is similar to Example I with the exception that the feed to the gasifier is composed of equal parts of solvent refined coal and filter cake obtained by the filtration of the liquid effluent from the solvation vessel. To supply 7600 standard cubic feet per day of synthesis gas, 146 pounds per day of filter cake and 146 pounds per day of solvent refined coal are required. The mixture has the following composition:

TABLE 4

| | |
|---|---|
| Carbon, wt. % | 66.4 |
| Hydrogen wt. % | 3.8 |
| Nitrogen, wt. % | 1.4 |
| Sulfur, wt. % | 0.6 |
| Oxygen, wt. % | 2.8 |
| Ash, wt. % | 25.0 |

The gasification is accomplished by reacting the mixture with 264 pounds per day of oxygen of 98% purity and 186 pounds per day of water. The product gas has the following composition:

TABLE 5

| | | |
|---|---|---|
| Hydrogen, | mol. % | 33.2 |
| CO | mol. % | 47.7 |
| $CO_2$ | mol. % | 16.8 |
| $CH_4$ | mol. % | 0.8 |
| N | mol. % | 0.6 |
| A | mol. % | 0.7 |
| $H_2S$ | mol. % | 0.2 |

The slag formed in the gasifier is removed through a lock hopper at the bottom of the quench chamber and 388 pounds per day of quench water containing dispersed soot is mixed with 258 pounds per day of naphtha and the soot transferred to the solvent refined coal as in Example I. By proceeding as in this example, there is a net yield of 854 pounds per day of solvent refined coal as distinguished from a yield of 788 pounds per day in Example I.

Although these examples show the production of solvent refined coal with no excess gas production, it will be obvious to those skilled in the art that additional solvent refined coal may be sent to the gasification zone for the production of synthesis gas for external use such as the production of chemicals, e.g., alcohols or for use as a fuel per se or for conversion to methane.

Various modifications of the invention as hereinbefore set forth may be made without departing from the spirit and scope thereof, and therefore, only such limitations should be made as are indicated in the appended claims.

We claim:

1. A continuous process for the production of synthesis gas which comprises the steps of a. mixing finely divided solid carbonaceous fuel with a solvent therefor, b. heating the resulting mixture to a temperature between about 700° and 900° F. in a solvation zone to solubilize said solid fuel, c. removing the heated mixture of solvent and solubilized fuel from the solvation zone, d. separating unsolubilized mineral residue from the liquid portion of the solvation zone effluent, e. adding to said liquid portion a suspension of particulate carbon in a hydrocarbon liquid
f. distilling the mixture formed in step (e) to remove liquids boiling up to about 450° F.
g. separating the still residue from step (f) into a fraction boiling up to about 900° F. and a residual fraction containing particulate carbon boiling above about 900° F.
h. returning the fraction boiling up to about 900° F. to solvation zone as solvent
i. combining the mineral residue of step (d) with the residual fraction of step (g)
j. subjecting the mixture from step (i) to partial combustion to form a gas comprising hydrogen and carbon monoxide and containing particulate carbon
k. transferring the particulate carbon of step (j) to suspension in the liquids boiling up to about 450° F. of step (f) and
l. adding the suspension of step (k) to the liquid portion of the solvation zone effluent as in step (e).

2. The process of claim 1 in which step (b) is carried out in the presence of added hydrogen.

3. The process of claim 2 in which the added hydrogen comprises synthesis gas produced in step (j).

4. The process of claim 3 in which the synthesis gas is scrubbed by contact with water and the synthesis gas introduced into the solvation zone is substantially soot-free.

5. The process of claim 1 in which the synthesis gas is cooled by contact with water thereby forming a suspension of soot in water and the soot is recovered from the water suspension by intimately contacting the water suspension with the hydrocarbon liquid boiling up to about 450° F.

6. The process of claim 5 in which the hydrocarbon liquid boiling below about 450° F. is added to the water dispersion in an amount just sufficient to cause the soot particles to rise to the surface of the water and the soot is removed from the surface of the water by the addition of more hydrocarbon liquid to form a hydrocarbon liquid-soot dispersion.

7. The process of claim 6 in which the hydrocarbon liquid is added in an amount sufficient to form a soot-hydrocarbon liquid dispersion containing between about 1 and 5 weight % soot.

8. The process of claim 2 in which unconsumed hydrogen is recovered from the solvation zone effluent and is recycled to the solvation zone.

9. The process of claim 8 in which sulfur compounds are removed from the recycle hydrogen prior to its return to the solvation zone.

10. The process of claim 2 in which hydrogen is removed from the solvation zone effluent.

* * * * *